US006152698A

United States Patent [19]

Gregg et al.

[11] Patent Number: 6,152,698

[45] Date of Patent: Nov. 28, 2000

[54] KIT OF ARTICLES AND METHOD FOR ASSEMBLING ARTICLES ALONG A HOLDER DISTANCE

[75] Inventors: Scott F. Gregg, West Rutland; John J. Saltis, Castleton; Michael C. Johnson, North Clarendon, all of Vt.

[73] Assignee: General Electric Company, Cincinnati, Ohio

[21] Appl. No.: 09/365,477

[22] Filed: Aug. 2, 1999

[51] Int. Cl.[7] ..... F01D 5/22

[52] U.S. Cl. ..... 416/215; 416/193 A; 416/248; 29/889.21; 29/889.22; 29/407.05; 29/428

[58] Field of Search ..... 416/193 A, 215, 416/216, 217, 218, 248; 29/889.21, 889.22, 407.05, 428

[56] References Cited

U.S. PATENT DOCUMENTS 4,878,811 11/1989 Jorgensen ..... 416/215

5,666,724 9/1997 Kolsun ..... 29/407.05

FOREIGN PATENT DOCUMENTS 349624 12/1960 Switzerland ..... 416/215

*Primary Examiner*—F. Daniel Lopez
*Assistant Examiner*—Liam McDowell
*Attorney, Agent, or Firm*—Andrew C. Hess; Gerry S. Gressel

[57] ABSTRACT

A final kit of a selected plurality of first and second groups of articles, for example turbine engine blading members, for subsequent assembly within a tolerance range along a distance in an article holder, is provided prior to assembly in the holder. This is accomplished by measuring dimensions of the first and second groups, and adjusting, if necessary, the numbers of articles in each group while maintaining the total number in the plurality.

14 Claims, 2 Drawing Sheets

KIT OF ARTICLES AND METHOD FOR ASSEMBLING ARTICLES ALONG A HOLDER DISTANCE

BACKGROUND OF THE INVENTION

This invention relates to the assembly of a selected plurality of articles along a substantially fixed distance in an article holder. More particularly, it relates to the assembly of a kit of a selected plurality of articles, including airfoils, about the periphery of a rotating or stationary holder such as a spool, drum, disc, casing, etc.

Power generating apparatus, such as a turbine engine, in one form includes at least one row or stage of blading members which include at least one radially extending airfoil, disposed generally in a row circumferentially about a holder, for example a rotating disc, drum or spool, or a stationary casing. Examples of such members in gas turbine engines are shown in U.S. Pat. Nos. 5,281,087—Hines (patented Jan. 25, 1994); 5,232,339—Plemmons et al. (patented Aug. 3, 1993); and 5,443,365—Ingling et al. (patented Aug. 22, 1995). Such arrangements have been designed for use in various sections of an engine, including the compressor, turbine, and/or fans that have been located in the front or rear sections of the engine. One design of such a holder includes a circumferentially disposed channel or slot at the rim portion of the holder and into which the blading members are placed sequentially during assembly.

It is well known that design of such apparatus, for efficient power production, includes control of gas flow through the apparatus, for example air alone or in combination with products of combustion. To assist in such control, the design includes a specific selected number or plurality of airfoils at various locations in the gas flow stream. For example, each stage or circumferentially disposed row of compressor blading members in a rotating compressor blading member holder, such as a disc, drum or spool, includes a pre-selected number of generally radially outward extending airfoils. The blading members are disposed circumferentially about the holder substantially in a complete circle, allowing a pre-selected tolerance range for the sum of spacing between blades about the circle. To establish such spacing, a portion of each blading member, which includes at least one airfoil, is designed and manufactured for assembly circumferentially about the holder. Such portion, herein called a spacer portion, for example a blade platform or a blade base, has a spacer portion dimension selected to enable such spacing about the holder.

One practice in the design of gas turbine engine compressor blading members and their holders is to select more than one group of blading members, each group having such spacer portion dimension different from the other group, for intermingled distribution of the selected number of members about the holder. For example, a circumferential length of an edge of a compressor blade platform, disposed between a base and an airfoil, represents one type of spacer portion dimension. For the proper assembly of such groups of blading members in a holder, in order to maintain any final gap remaining after assembly within a design tolerance range, it has been a practice first physically to assemble the required number of blading members in the holder to determine a preliminary gap. If the preliminary gap was greater than the tolerance range, or if the sum of the spacer portion dimensions was greater than the space within the holder, a physical, iterative type of substitution of members of one group or the other was conducted until any end gap was within the tolerance range. Such a practice of iterative substitution of blading members in a holder can be time consuming and require inordinately larger supplies of blading members at an assembly location. Typically, blading members are manufactured at one location and such blading members are assembled into a holder at another, sometimes distant, location. Provision, prior to assembly in a holder, of a kit of the articles to fit in the holder within the design tolerance range, and a method for providing such a kit would reduce assembly time and expense.

BRIEF SUMMARY OF THE INVENTION

The present invention, in one form, provides steps in a method for assembling a selected plurality of articles along a holder distance in an article holder, each article including a spacer portion designed to be assembled in the article holder along the holder distance. The selected plurality of articles comprises a first group of articles each including a first spacer portion defined in part by a first dimension, and a second group of articles each including a second spacer portion defined in part by a second dimension greater than the first dimension. The first and second dimensions are designed to be disposed, when the articles are assembled in the article holder, along the holder distance. The total of the first and second dimensions of the plurality of articles are selected to be substantially the same as the holder distance within a tolerance range.

The method comprises providing a kit of the selected plurality of articles, prior to final assembly of the articles in the article holder. The kit is provided by first selecting the plurality of articles from the first and second groups of articles. Then the first dimension of each first spacer portion of each of the first group of articles and the second dimension of each second spacer portion of the second group of articles is measured. All of the first and second dimensions are added together to provide a total distance which is compared with the holder distance.

In one form of the invention, if any difference between the total measured distance and the design holder distance is within the tolerance range, the kit is provided. Then the kit of the plurality of articles can be assembled in the article holder.

If the total measured distance is less than the holder distance by a length larger than the tolerance range, then the articles in the first group are reduced by a number, and the articles in the second group are increased by that number, thereby increasing the total measured distance for the potential kit, until the total measured distance is within the tolerance range. In this way, the kit is provided. Then the kit of the plurality of articles can be assembled in the article holder.

If the total measured distance is greater than the holder distance by a length larger than the tolerance range, then the articles in the second group are reduced by a number, and the articles in the first group are increase by that number, thereby decreasing the total measured distance for the potential kit, until the total measured distance is within the tolerance range. In this way, the kit is provided. Then the kit of the plurality of articles can be assembled in the article holder.

Another form of the present invention is a kit of the above-described first and second groups of articles with the total of the first and second dimensions substantially the same as the holder distance within the tolerance range.

DETAILED DESCRIPTION OF THE INVENTION

The present invention can be used in connection with the assembly of a row or sequence of a variety of articles. However, it is particularly useful in connection with turbine engine blading members designed for assembly in substantially a complete circle about the engine axis. Examples of such an arrangement in a gas turbine engine compressor are shown in U.S. Pat. Nos. 3,923,420—Chifos (patented Dec. 2, 1975); and 5,232,346—Mitchell, Jr., et al. (patented Aug. 3, 1993).

Figure 1:
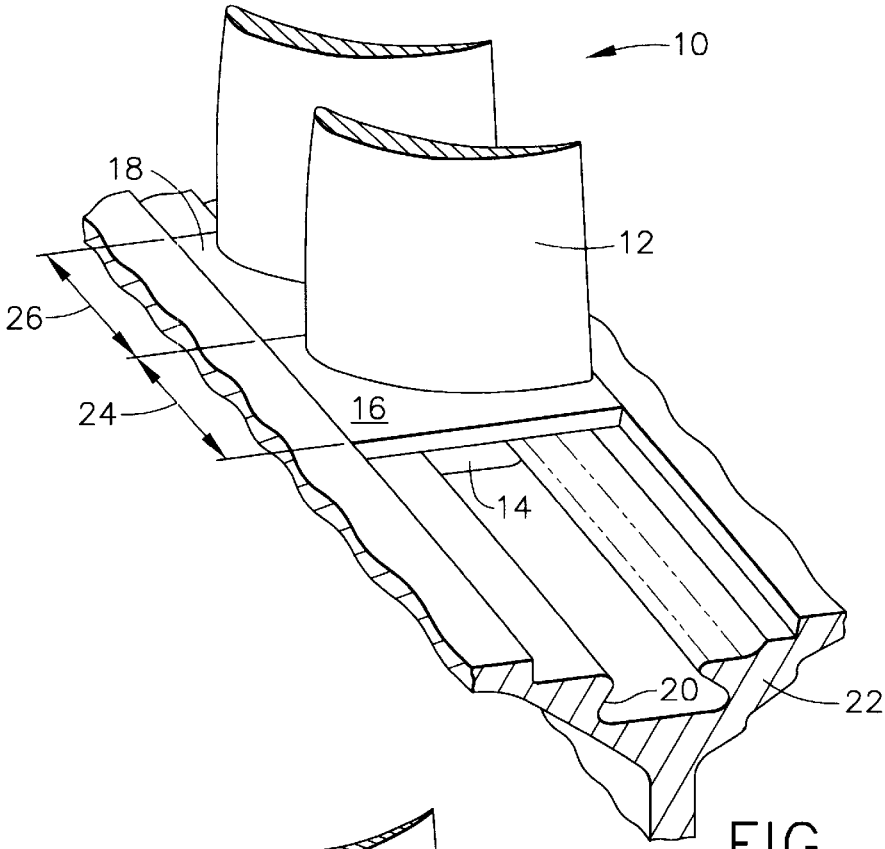
FIG. 1 is a fragmentary, sectional view of a stage of turbine engine compressor blades assembled in a circumferentially disposed slot in a compressor rotor.

The present invention will be more fully understood by reference to the drawings. FIG. 1 is a fragmentary, sectional view of a row or stage of articles in the form of turbine engine compressor blades shown generally at 10, similar to the arrangement in FIG. 1 of the above-identified Chifos patent. Blades 10 include an airfoil 12, a base 14, and platforms 16 or 18 there between. Blades 10 are assembled in a circumferentially disposed slot 20 in compressor rotor 22, herein representing a form of article holder. Typical forms of compressor rotor 22, shown in fragment in FIG. 1, includes discs or wheels, drums, and spools, including therein the circumferential slot, or a plurality of circumferential slots, as is well known in the gas turbine art.

Design of a row or stage of articles such as the assembly of compressor rotor blades 10 in FIG. 1 includes an allowable total circumferential gap tolerance range for the circular array of blades, representing a tolerance range designed for articles disposed along a holder distance. An example of a holder distance is the total distance of slot 20. As was stated above, it is a practice in some forms of assemblies as in FIG. 1 to include at least two groups of compressor blades. The groups, sometimes referred to as "wide" and "narrow" in respect to the blades, are established in respect to a circumferential length or dimension of the platform, at least in part to facilitate adjustment of the size of an end gap: the gap remaining after assembly.

In FIG. 1, a first group of blades, represented by blade 10 with platform 16 as a spacer portion, is defined in part by a first dimension 24 in the circumferential direction. A second group of blades, represented by blade 10 with platform 18 as a spacer portion, is defined in part by a second dimension 26 in the circumferential direction, second dimension 26 being greater than first dimension 24. When the number in each of the groups of blades is selected properly, a total or end gap will be within the design tolerance range.

Figure 2:
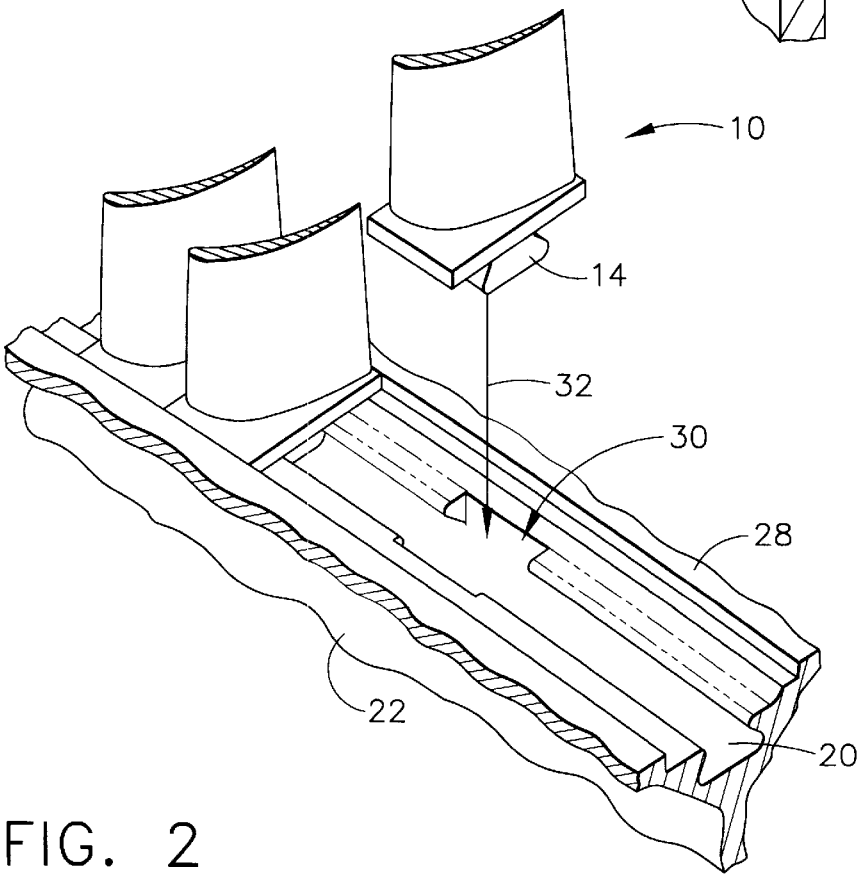
FIG. 2 is a diagrammatic fragmentary view of the assembly of the blades of FIG. 1 into the slot.

The diagrammatic, fragmentary view of FIG. 2 shows a typical method for introducing blades 10 into circumferential slot 20 in rotor 22 for assembly. Outer rim 28 of rotor 22 includes an entry opening 30 communicating with circumferential slot 20. Each blade base 14 is disposed through entry opening 30 as shown by arrow 32 and then moved circumferentially within slot 20 until the slot is filled circumferentially with the designed number of blades. Periodically during assembly, blades that include a typical locking means commonly used in the art, not shown, are introduced into the slot to facilitate locking of the blades in the slot.

Figure 3:
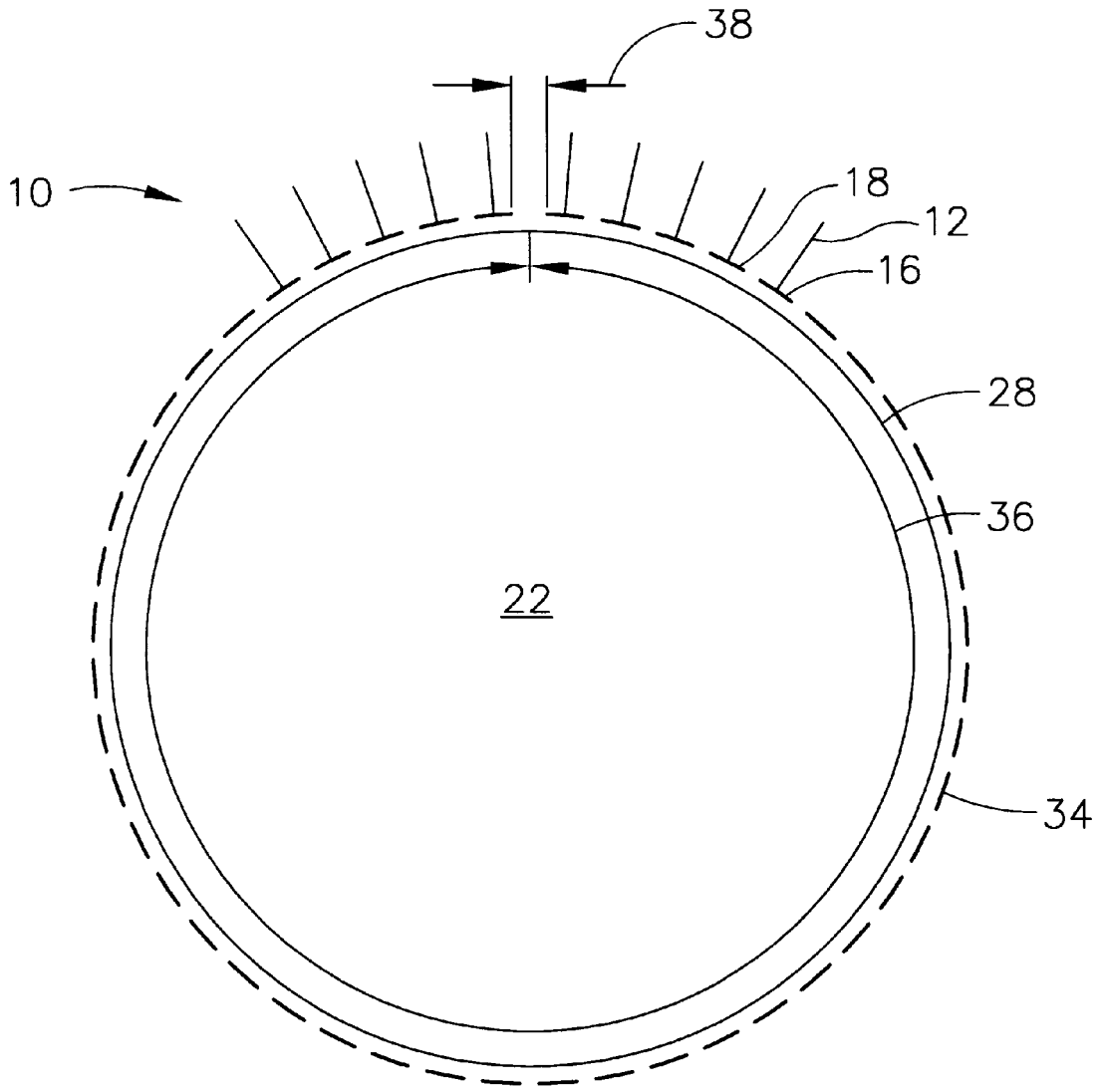
FIG. 3 is a diagrammatic presentation of an assembly of blading members circumferentially about a blade holder.

FIG. 3 is a diagrammatic presentation of a full assembly of blades 10 circumferentially in slot 20 of rotor 22. Radially extending lines 12 represent airfoils; circumferentially spaced-apart lines 16 and 18 represent platforms of the above-described groups of blades. For simplicity of presentation, only a segment of the blades are represented, the balance being represented by the broken line 34 extending circumferentially from the blades depicted. In FIG. 3, circular arrow 36 represents the holder distance of the total of first and second dimensions 24 and 26 of platforms 16 and 18 around rim 28 and along which blades 10 are assembled. Blades 10 substantially fill slot 20 so that the sum of the first and second platform dimensions 24 and 26 establish a total or end gap 38.

Prior to the present invention, in order to establish that gap 38 is within a design tolerance range, the iterative type of substitution series of steps, described above, was conducted. According to the present invention, such a time consuming process is avoided by providing a kit of a plurality of articles, such as a design number of blading members, selected to fit within a holder distance in an article holder, for example in a slot in a compressor rotor.

In one form of the method of the present invention, the first dimension, for example 24 in FIG. 1, of each of a number of "narrow" blades 10 in a first group of blades is measured. Also, the second dimension, for example 26 in FIG. 1, of each of a number of "wide" blades 10 in a second group of blades is measured. A plurality of blades is selected from each group so that the total selected number equals the number of blades designed to be assembled in the circumferential slot. The slot is designed and manufactured to have a total distance within the blade holder, such as a rotor.

In one specific example, stage 5 of a compressor rotor of an engine in the CF6-80 family of gas turbine engines, was designed to include an assembly of a total of 104 blades. For example, that total can include 20 blades from the first group, each blade having a platform 16 with a first dimension 24, sometimes called a "narrow". That total also can include 84 blades (4 of which include locking means to secure the blades within the slot 20) each blade having a platform 18 with a second dimension 26 greater than the first dimension 24 and sometimes called a "wide". The final assembly of blades along the defined distance in the slot 20 is intended to allow an end gap within a design tolerance range.

In one series of evaluations of that embodiment of the method, 20 "narrow" and 84 "wide" blades (including 4 locking blades) arbitrarily were selected, respectively, from the first and second groups of blades for a stage of blades designed to include a total of 104 blades. The sum of the measured first and second dimensions was determined to provide a total distance that the first and second dimensions for that particular selection of blades would extend if assembled in a slot. That total distance was compared with the actual design distance of the holder.

When any difference between the total measured distance and the design distance was within the design tolerance range, a kit of 104 blades comprising the 20 blades from the first group of blades and the 84 blades from the second group of blades (including 4 locking blades) was provided for assembly in the slot.

When the total measured distance was less than the design distance, representing the potential end gap, by a length larger than the design tolerance range, thereby being outside of that tolerance range, a greater total measured distance for that particular selection of blades was required. In that case, a number of one or more blades from the second, wider group of blades was substituted for that same number of blades from the first, narrow group of blades. Such substitution, which increased the total measured distance for the potential kit, was conducted until the total measured distance for the selection of blades was within the design tolerance range. Such substitution retained the same total number of blades, for example at 104, but increased the number of blades in the second group. In this way, a kit of blades was provided for assembly in the slot.

When the total measured distance was greater than the design distance by a length larger than the design tolerance range, indicating that the total measured distance for the potential kit of blades was too large for the slot distance, a smaller total measured distance for that particular selection of blades was required. For example, for a design distance of 53.602" and design tolerance of 0.005" (plus or minus), a total measured distance of a potential kit of blades at 53.6185" is too large. A number of one or more blades from the first, narrower group of blades was substituted for that same number of blades from the second, wider group of blades. Such substitution, which decreased the total measured distance for the potential kit, was conducted until the total measured distance for the selection of blades was within the design tolerance range. That substitution retained the same total number of blades in the kit but increased the number blades in the first group. In this way, a kit of blades was provided for assembly in the slot.

As represented by the embodiment of the present invention described in the above specific series of evaluations, a kit of a pre-selected plurality of articles, for example blading members, is provided for accurate assembly within a tolerance limit or range in an article holder prior to actual, physical assembly of the articles in the holder. Such a kit has been assembled at one location, shipped to another location and assembled without requiring any potential iterative type of effort to provide an assembly within a tolerance range.

Another form of the present invention, in addition to providing the kit of a pre-selected plurality of articles, predetermines the order in which each of the articles is to be assembled in the article holder that is intended to be rotated in balance during operation. An example of such an assembly is the above described turbine engine compressor rotor. The order of assembly of the pre-selected articles is based on the relative weight of each article and the effect of the relative position of each article on the rotating balance of the assembly. In this form of the invention, the weight of each article in the first and second groups is determined in addition to the lengths of the first and second dimensions. After provision of the kit, as described above, a balanced array of the articles is provided by calculating the relative position and order of the articles in the article holder in a rotationally balanced arrangement. Then the articles are assembled in the order determined.

The present invention, in its various forms as methods and kits of articles, has been described in connection with specific examples and embodiments. However, it should be understood that they are intended to be representative of, rather than in any way limiting on, its scope. Those skilled in the arts involved will understand that the invention is capable of variations and modifications without departing from the scope of the appended claims.

What is claimed is:

1. In a method for assembling a selected plurality of articles along a holder distance in an article holder, each article including a spacer portion designed to be assembled in the article holder along the holder distance, the selected plurality of articles comprising a first group of articles each including a first spacer portion defined in part by a first dimension, and a second group of articles each including a second spacer portion defined in part by a second dimension greater than the first dimension, the first and second dimensions being designed to be disposed, when the articles are assembled in the article holder, along the holder distance, the total of the first and second dimensions of the plurality of articles being selected to be substantially the same as the holder distance within a tolerance range, the steps prior to assembly of the articles in the holder for providing a final kit of:

providing a first group of the articles each including a first spacer portion having a first dimension, and a second group of articles each including a second spacer portion having a second dimension;

providing a preliminary kit of the selected plurality of the articles by selecting articles from the first group and from the second group;

measuring the first and second dimensions of the articles in the preliminary kit to provide measured dimensions;

adding the measured first and second dimensions to provide a total measured distance for the preliminary kit; and, comparing the total measured distance with the holder distance.

2. The method of claim 1 further comprising the steps:

if any difference between the total measured distance and the holder distance is within the tolerance range, a final kit is provided;

if the total measured distance is less than the holder distance by a length larger than the tolerance range, articles in the first group are reduced by a number and articles in the second group are increased by the number until the total measured distance is within the tolerance range to provide a final kit;

if the total measured distance is greater than the holder distance by a length larger than the tolerance range, articles in the second group are reduced by a number and articles in the first group are increased by the number until the total measured distance is within the tolerance range to provide the final kit.

3. The method of claim 2 in which the final kit is assembled in the article holder.

4. The method of claim 2 in which the articles are turbine engine blading members.

5. The method of claim 4 in which the articles and article holder comprise a balanced bladed turbine engine rotor assembly.

6. The method of claim 5 in which each of the articles is a turbine engine compressor rotor blade.

7. The method of claim 6 in which each of the first and second spacer portions is a platform of the blade.

8. The method of claim 5 in which:

the weight of each of the blading members in the final kit is determined; and, the articles are arranged for assembly in an order based on the weight of each of the blading members to provide a substantially balanced rotor assembly.

9. A kit of a selected plurality of articles for assembly along a distance in an article holder within a tolerance range, the kit comprising;

a first group of articles each including a first spacer portion defined in part by a first dimension; and, a second group of articles each including a second spacer portion defined in part by a second dimension greater than the first dimension;

the first and second dimensions being designed to be disposed, when assembled in the article holder along the distance;

the total of the first and second dimensions being substantially the same as the distance within the tolerance range.

10. The kit of claim 9 in which the articles are turbine engine blading members.

11. The kit of claim 10 in which the turbine engine blading members are compressor rotor blades.

12. The kit of claim 11 in which each of the first and second spacer portions is a platform of the blade.

13. The kit of claim 9 in which:

each of the articles has a weight; and, each of the articles is arranged for assembly in an order based on the weight of each article to provide a substantially balanced rotor assembly.

14. The kit of claim 13 in which the articles are turbine engine rotor blades.

* * * * *